US007522161B2

(12) United States Patent
Kataoka et al.

(10) Patent No.: US 7,522,161 B2
(45) Date of Patent: Apr. 21, 2009

(54) IMAGE PROCESSING DEVICE AND IMAGE PROCESSING METHOD

(75) Inventors: Noriyasu Kataoka, Kanagawa (JP); Toshiyuki Ogura, Tokyo (JP)

(73) Assignee: Sony Corporation, Tokyo (JP)

( * ) Notice: Subject to any disclaimer, the term of this patent is extended or adjusted under 35 U.S.C. 154(b) by 715 days.

(21) Appl. No.: 11/130,503

(22) Filed: May 17, 2005

(65) Prior Publication Data

US 2006/0012613 A1 Jan. 19, 2006

(30) Foreign Application Priority Data

May 18, 2004 (JP) ..... 2004-148078

(51) Int. Cl.
*G09G 5/00* (2006.01)

(52) U.S. Cl. ..... 345/204; 345/55; 345/82; 345/690

(58) Field of Classification Search ..... 345/204, 345/690, 55, 82

See application file for complete search history.

(56) References Cited

U.S. PATENT DOCUMENTS

2004/0080640 A1 * 4/2004 Aoki et al. ..... 348/272

* cited by examiner

*Primary Examiner*—Richard Hjerpe
*Assistant Examiner*—Leonid Shapiro
(74) *Attorney, Agent, or Firm*—Frommer Lawrence & Haug LLP; William S. Frommer; Thomas F. Presson

(57) ABSTRACT

An image processing device for displaying an image in high quality on color image display using fixed pixels. The image processing device causes a display device making pixels of R, G and B arranged inside each of a plurality of areas on a screen emit light to display a designated color in unit areas. A signal generation circuit determines a pixel of which an arrangement position is not matched with a reference position of the unit area used for reference by a first pixel signal as a target to be interpolated among pixels of R, G and B, generates a second pixel signal which uses the arrangement position of the pixel to be interpolated as a reference on the basis of the first pixel signal.

6 Claims, 12 Drawing Sheets

FIG. 2B VDEO

IMAGE PROCESSING DEVICE AND IMAGE PROCESSING METHOD

CROSS REFERENCES TO RERATED APPLICATIONS

The present invention contains subject matter related to Japanese Patent Application JP 2004-148078 filed in the Japanese Patent Office on May 18, 2004, the entire contents of which being incorporated herein by reference.

BACKGROUND OF THE INVENTION

1. Field of the Invention

The present invention relates to an image processing device used for a color image display used with fixed pixels and an image processing method used for the same.

2. Description of the Related Art

A color image display device used with fixed pixels such as a liquid crystal display or plasma display panel (PDP) has a plurality of unit areas which are provided in a matrix in a two-dimensional display region and in which pixels of red (R), green (G) and blue (B) (fixed pixels) are arranged continuously or with adjoining respectively.

For example, each of the pixels of R, G and B is formed with a pixel region of a stripe or mosaic shape in the unit area.

The color image display device makes the R pixel emit light on the basis of an R signal, the G pixel emit light on the basis of a G signal, and the B pixel emit light on the basis of a B signal. An emission of Light of the pixels of R, G and B placed in the unit area is visible as a color mixed them, so a designated color is displayed in the unit area.

Note that, the R, G and B signals are generated so as to respectively make a center of the unit area as a reference.

SUMMARY OF THE INVENTION

However, in the color image display device in related art, an arrangement position which the pixels of R, G and B are arranged in actual is not matched with the center of the unit area used for reference by the R, G and B signals, so that a gap corresponding to an interval of a stripe or mosaic occurs.

The gap is visible as a color shift at a contour portion of the image and causes a deterioration of an image quality.

The present invention is to provide an image processing device able to display an image in high quality by a color image display used with fixed pixels and an image processing method for the same.

According to an embodiment of the present invention, there is provided a image processing device which makes pixels of R, G and B arranged inside each of a plurality of the unit areas on a screen emit light to display a designated color in unit areas, the image processing device including: a signal generation circuit determining a pixel of which an arrangement position is not matched with a reference position of the unit area used for a reference by a first pixel signal of the pixel as a target to be interpolated among pixels of the R, G and B, and generating a second pixel signal which uses the arrangement position of the pixel to be interpolated as a reference on the basis of the first pixel signal.

According to an embodiment of the present invention, there is provided an image processing method driving a display device which makes pixels of R, G and B arranged inside each of a plurality of the unit areas on a screen emit light to display a designated color in unit areas, the image processing method including: a first step of determining a pixel of which an arrangement position is not matched with a reference position of the unit area used for reference by a first pixel signal of the pixel as a target to be interpolated among the pixels of R, G and B, and generating a second pixel signal which uses the arrangement position of the pixel to be interpolated as a reference on the basis of the first pixel signal; and a second step of driving an emission of light of the pixel corresponding to the second pixel signal on the basis of the second pixel signal generated in the first step.

An embodiment of the present invention is able to be provided an image processing device able to display an image in high quality by a color image display using fixed pixels and an image processing method used for the same.

BRIEF DESCRIPTION OF THE DRAWINGS

These features of embodiments of the present invention will be described in more detail with reference to the accompanying drawings, in which.

DESCRIPTION OF THE PREFERRED EMBODIMENTS

Hereinafter, preferred embodiments of a color image display according to the present invention will be explained with reference to the drawings.

First Embodiment

Figure 1:
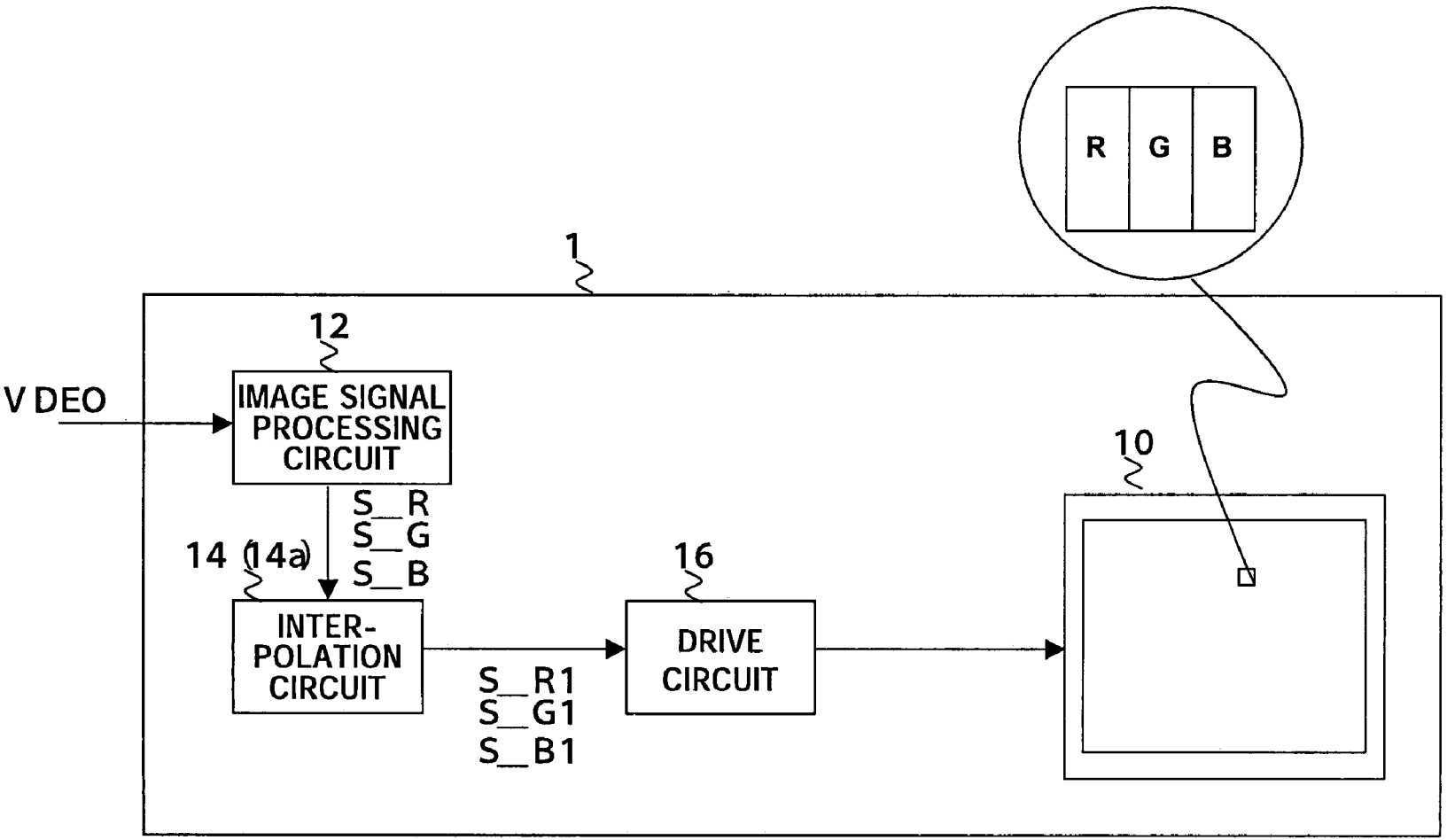
FIG. 1 is a view of a whole configuration of a color image display device according to a first embodiment of the present invention.

FIG. 1 is a view of a whole configuration of a color image display device 1 of the present embodiment.

As shown in FIG. 1, the color image display device 1 has a display 10, a video signal processing circuit 12, an interpolation circuit 14 and a drive circuit 16, for example.

The color image display device 1 is set to a device used with fixed pixels, such as a liquid crystal display and PDP.

(Display 10)

The display 10 is provided with, for example, rectangle unit areas in a matrix in a two-dimensional display region and arranged with R, G and B pixel regions inside each of the unit areas continuously or with adjoining respectively.

For example, the R, G and B pixel regions are formed with a stripe or mosaic shape in the unit area.

Figures 2A, 2C:
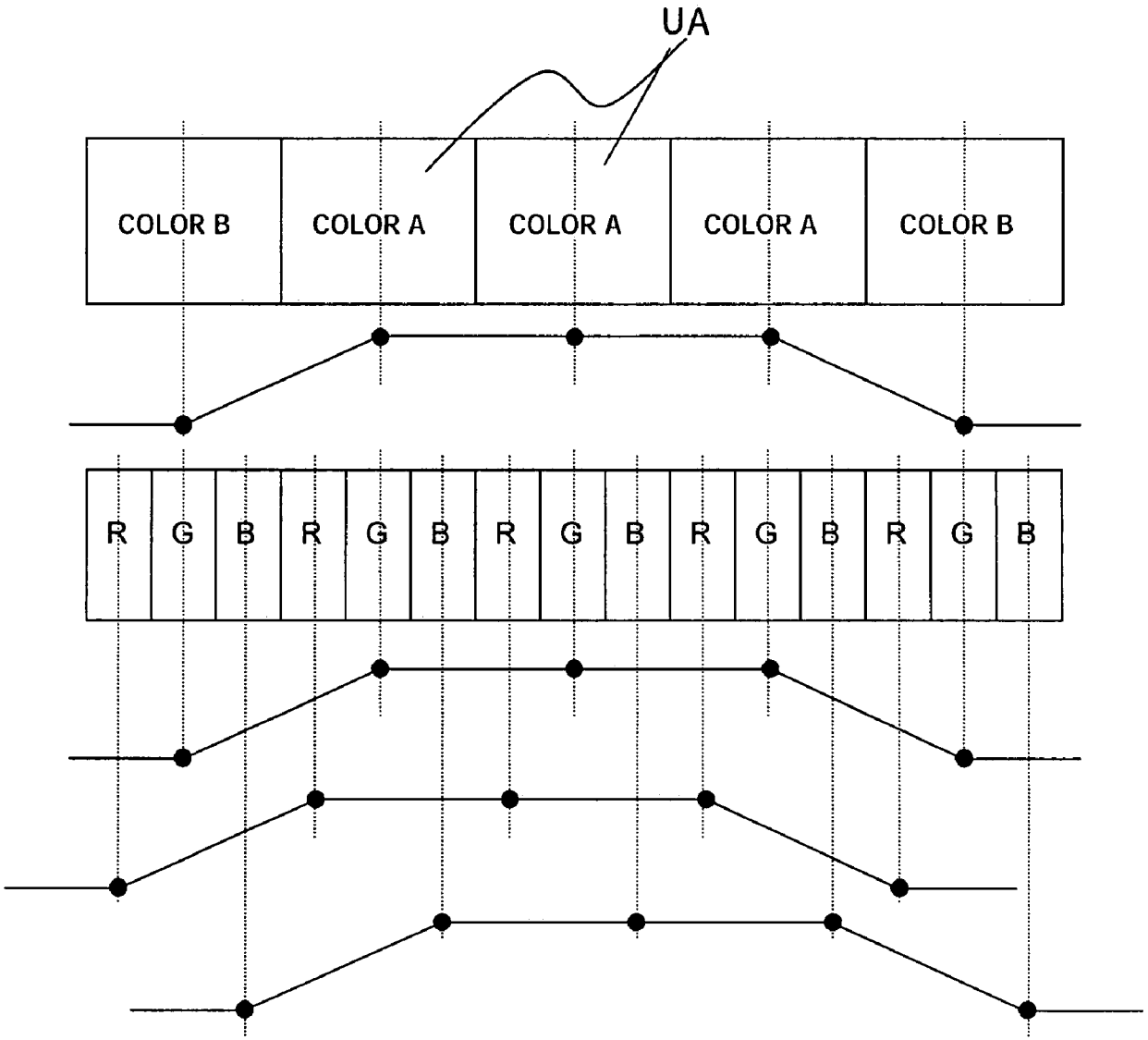
FIG. 2 is a view for illustrating the respective signals shown in FIG. 1.

In the present embodiment, the R, G and B pixel regions in the unit area are arranged from the left in order of the R pixel, the G pixel and the B pixel toward the right in a horizontal direction of a screen as shown in FIG. 1 and FIG. 2C.

(Video Signal Processing Circuit 12)

The video signal processing circuit 12 generates an R signal S_R, a G signal S_G and a B signal S_B on the basis of an video signal VIDEO which is input, and outputs them to the interpolation circuit 14.

FIGS. 2 and 3 are schematic views of the unit area and phases of the respective signals.

In the present embodiment, the video signal VIDEO has a phase shown in FIG. 2B The R signal S_R, the G signal S_G and the B signal S_B generated by the video signal processing circuit 12 have phases shown in FIGS. 2E, 2D and 2F respectively.

Figure 4:
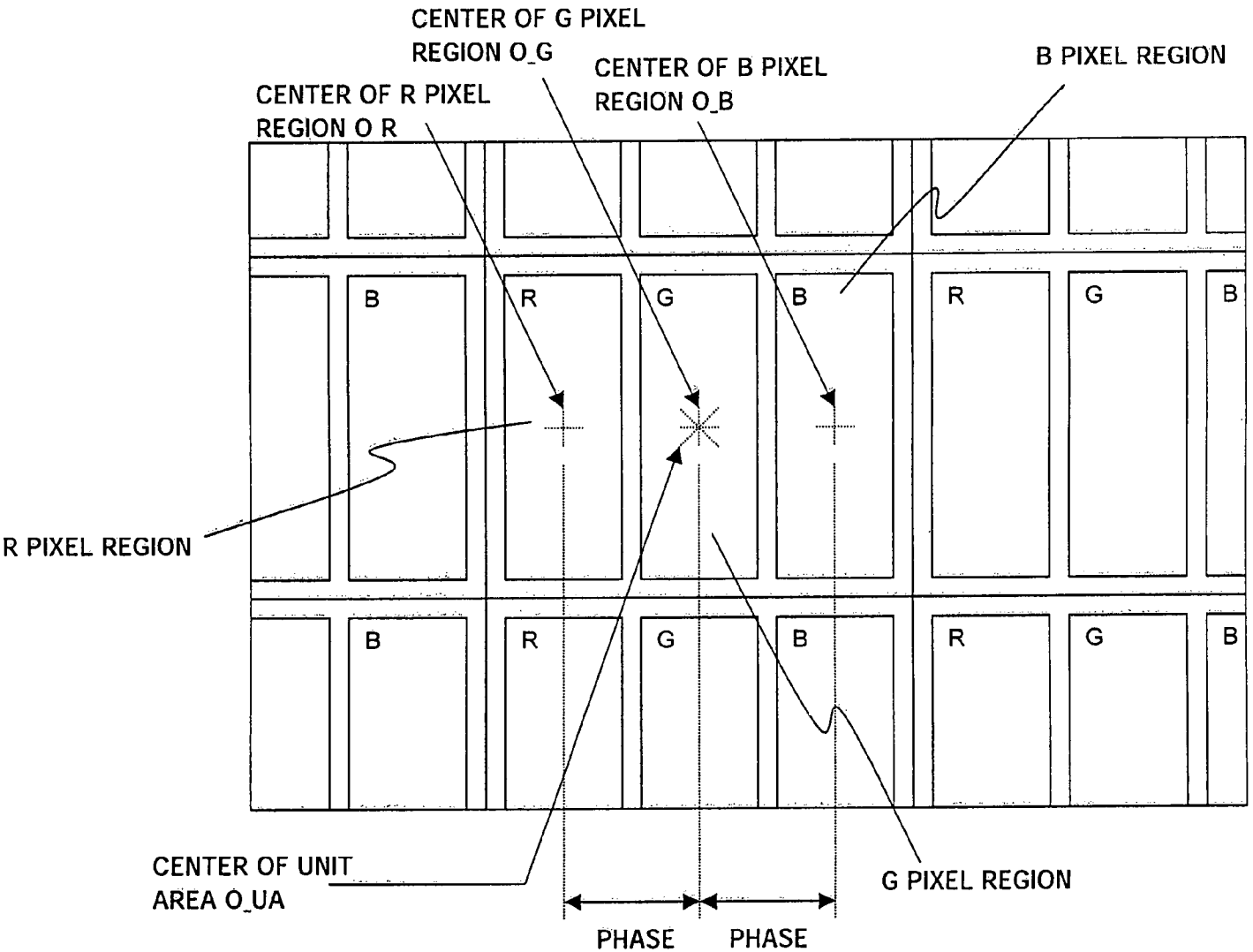
FIG. 4 is a view for illustrating the display device shown in FIG. 1.

FIG. 4 is a schematic view of an example of the unit areas.

The R signal S_R, the G signal S_G and the B signal S_B are generated by using a center O_UA of the unit area UA as a reference, not using centers O_R, O_G and O_B of each of the R, G and B pixel regions.

Therefore, if the R signal S_R, the G signal S_G and the B signal S_B having the phases shown in FIGS. 2E, 2D and 2F are output to the display 10 such as a color image display device in related art, the R, G and B pixel regions in the unit area UA may emit light on the basis of the R signal S_R, the G signal S_G and the B signal S_B and a so-called "phase shift" may occur.

In the present embodiment, the video signal processing circuit 12 outputs the R signal S_R, the G signal S_G and the B signal S_B shown in FIGS. 2E, 2D and 2F to the interpolation circuit 14. Then the interpolation circuit 14 generates an R signal S_R1, a G signal S_G1 and a B signal S_B1 shown in FIGS. 3C, 3B and 3D in accordance with an actual arrangement position of the R, G and B pixels in explanations blow.

(Interpolation Circuit 14)

Figure 5:
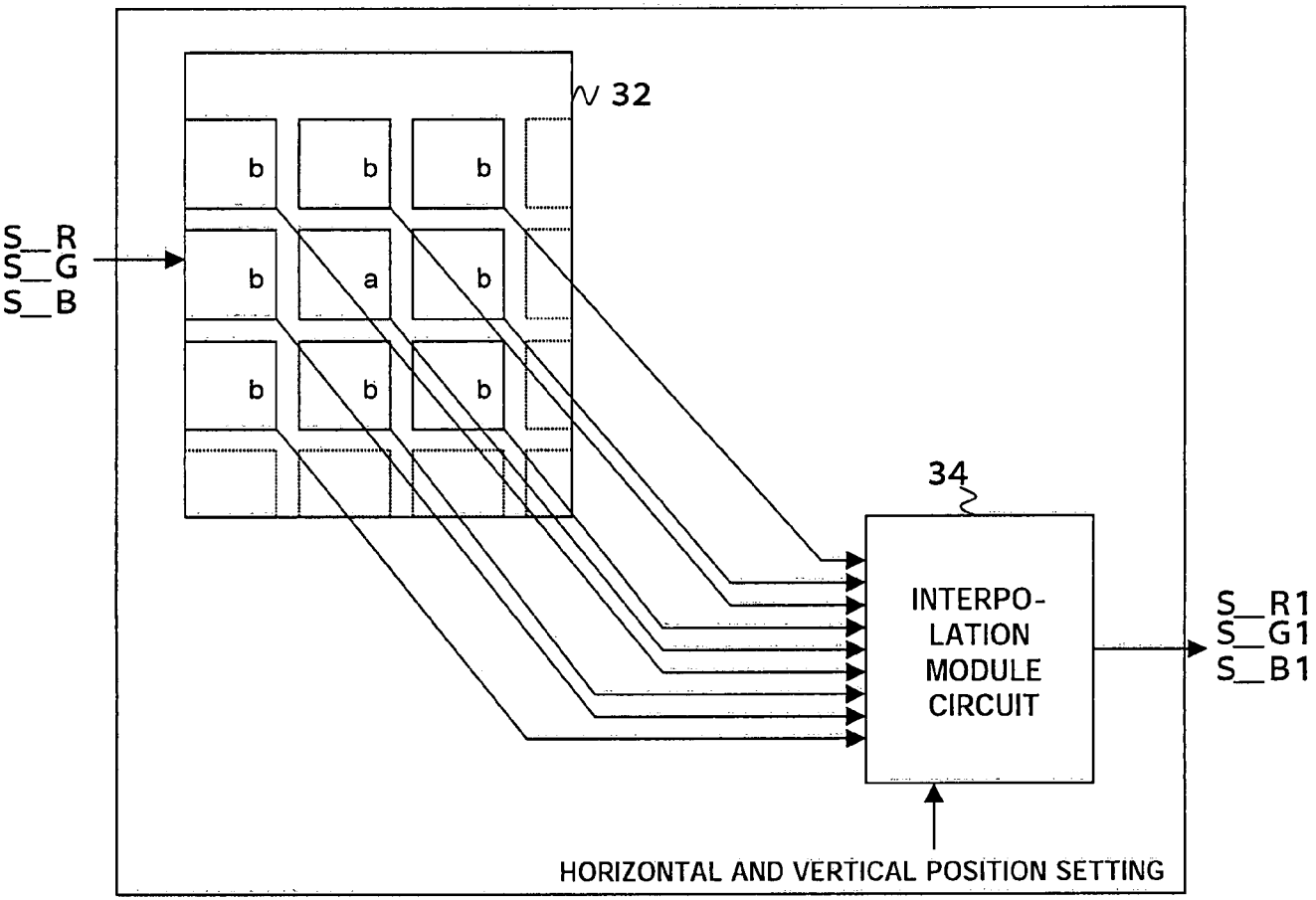
FIG. 5 is a view of a configuration of an interpolation circuit shown in FIG. 1.

FIG. 5 is a view of a configuration of the interpolation circuit 14 shown in FIG. 1.

As shown in FIG. 5, the interpolation circuit 14 has a memory 32 and an interpolation module circuit 34.

The memory 32 stores pixel data of the R signal S_R, the G signal S_G and the B signal S_B which are input from the video signal processing circuit 12.

The interpolation module circuit 34 performs an interpolation processing by using the R signal S_R and the B signal S_B generated by using the center O_UA of the unit area UA shown in FIG. 4 as a reference to generate the R signal S_R1 and the B signal S_B1 which uses each of the center O_R of the R pixel region and the center O_B of the B pixel region as references respectively.

In this time, the interpolation module circuit 34 receives a position determination of a horizontal direction and vertical direction in accordance with the centers O_UA, O_R and O_B, then performs the above interpolation processing on the basis of the position determination.

Figure 6:
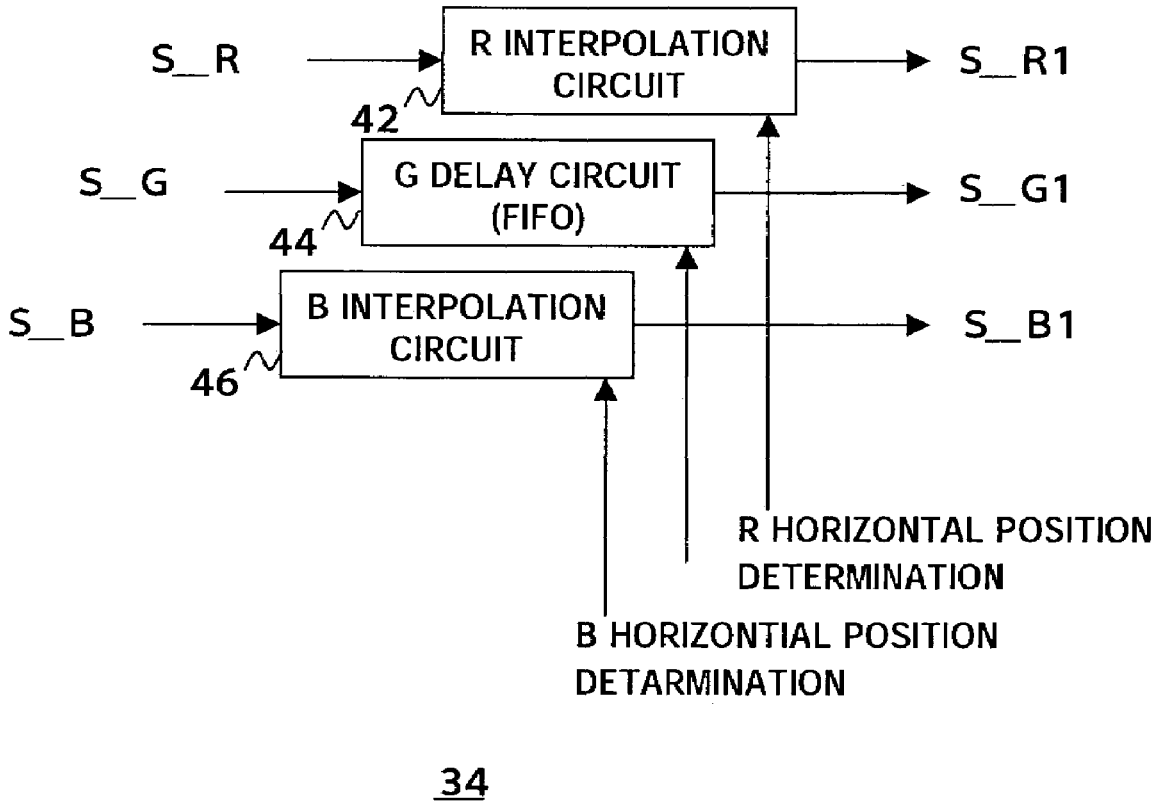
FIG. 6 is a view of a configuration of an interpolation module circuit shown in FIG. 5.

FIG. 6 is a view of a configuration of the interpolation module circuit 34 shown in FIG. 5.

As shown in FIG. 6, the interpolation module circuit 34 has an R interpolation circuit 42, a G delay circuit 44 and a B interpolation circuit 46, for example.

Figures 3A, 3B, 3C, 3D:
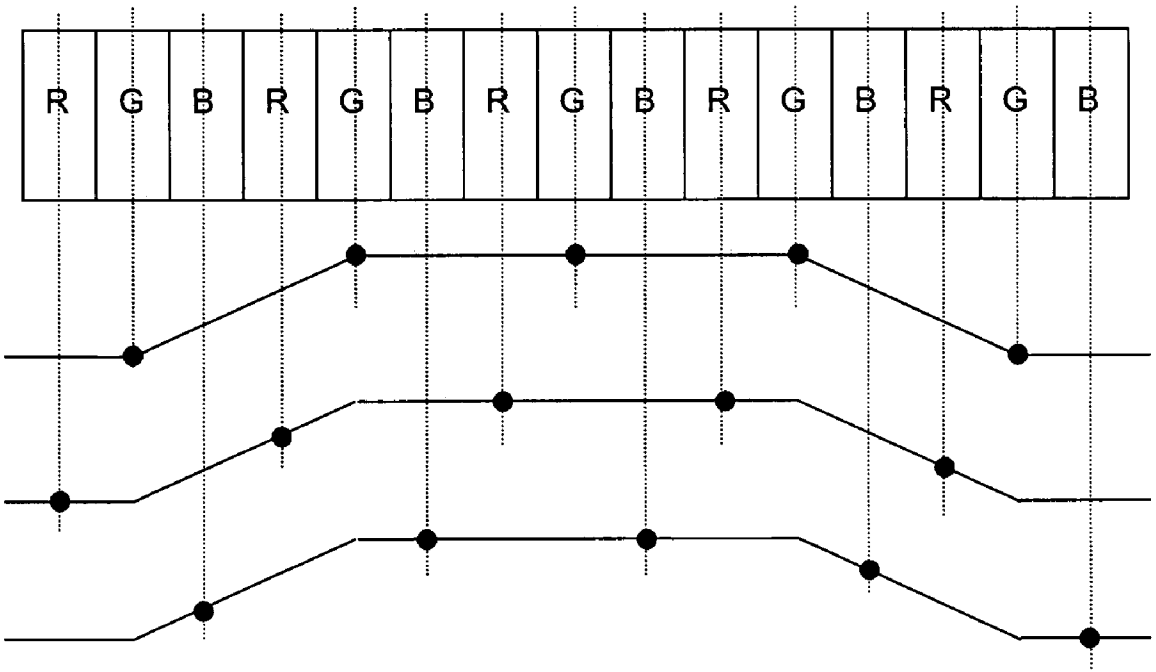
FIG. 3 is a view for illustrating the respective signals shown in FIG. 1.

The R interpolation circuit 42 generates the R signal S_R1 which uses the center O_R of the R pixel region as a reference as shown in FIG. 3C on the basis of the R signal S_R which uses the center O_UA of the unit area as a reference.

The G delay circuit 44 dose not perform the interpolation processing because the center O_UA of the unit area UA matches the center O_G, and is a FIFO (First-In First-Out) circuit delaying the G signal S_G for a processing time of the R interpolation circuit 42 and the B interpolation circuit 46 and then outputting it as the G signal S_G1 shown in FIG. 3B.

The B interpolation circuit 46 generates the B signal S_B1 which uses the center O_B of the B pixel region as a reference as shown in FIG. 3D on the basis of the B signal S_B which uses the center O_UA of the unit area UA as a reference.

Figure 7:
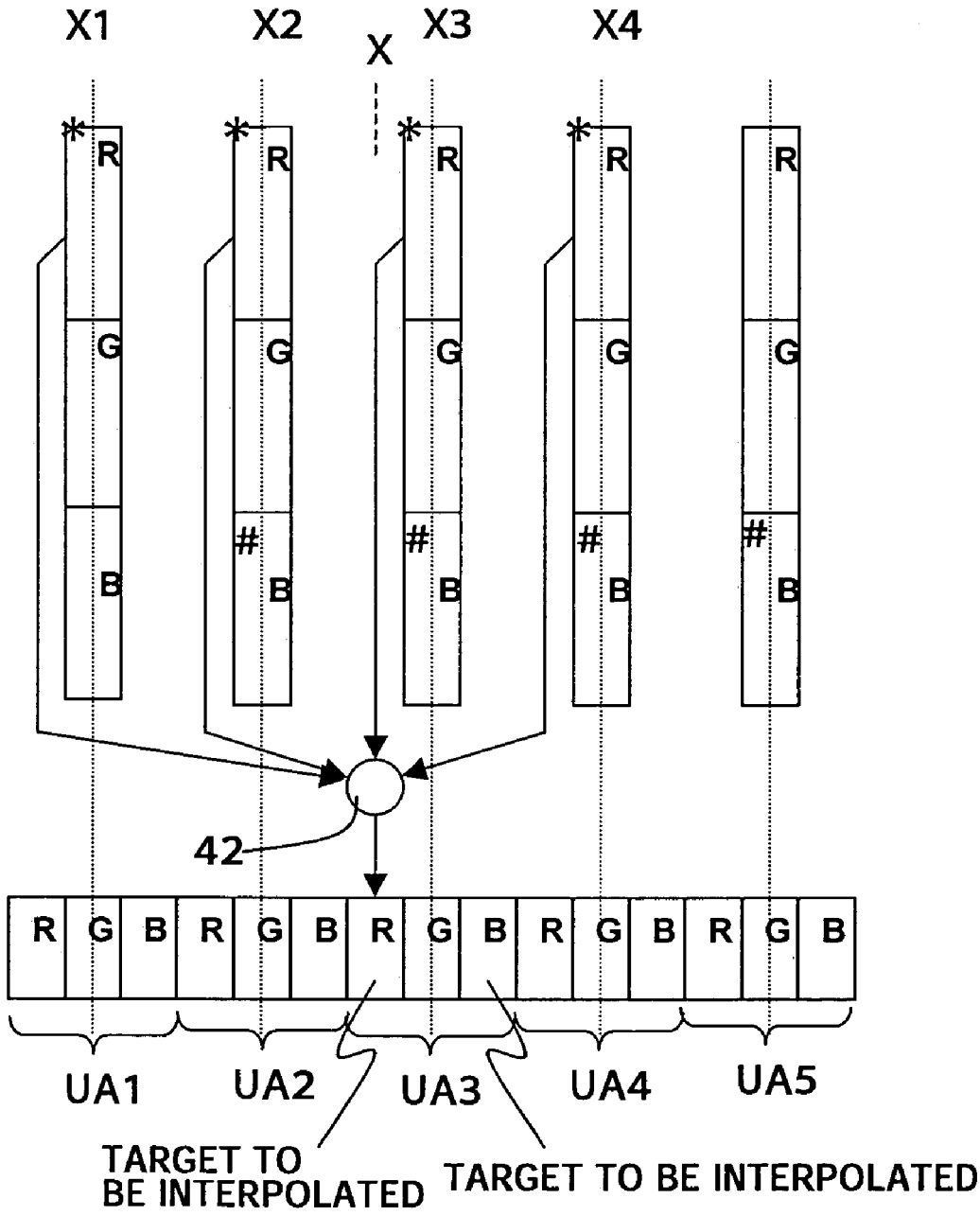
FIG. 7 is a view for illustrating an interpolation method by an R interpolation circuit shown in FIG. 6.
Figure 8:
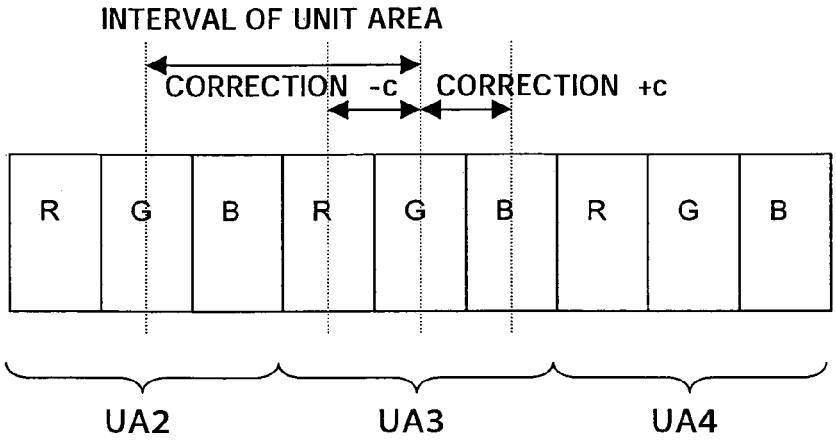
FIG. 8 is a view for illustrating a correction used by the R interpolation circuit shown in FIG. 7.

FIG. 7 is a view for illustrating an interpolation method by the R interpolation circuit 42. FIG. 8 is a view of an example of a correction of the pixel region.

An example shown in FIG. 7 shows a case generating an R pixel data of the R signal S_R1 in the unit area UA3.

Note that, in the present embodiment, an interval of the adjoining pixel regions in the horizontal direction is indicated by a "c" as shown in FIG. 8.

Therefore, the right direction in the horizontal direction shown in FIG. 8 is assumed as a plus, so the correction of the pixel data of the R signal S_R may be indicated by a "−c" and the correction of the pixel data of the B signal S_B may be indicated a "c".

Figure 9:
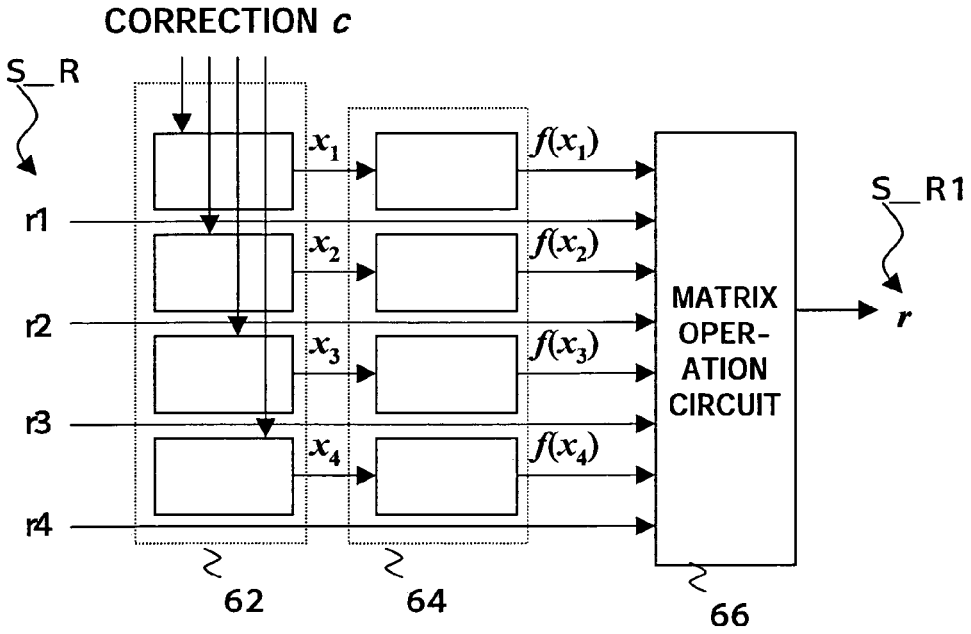
FIG. 9 is a view of a configuration of the R interpolation circuit shown in FIG. 6.

FIG. 9 is a view of a configuration of the R interpolation circuit 42 shown in FIGS. 6 and 7.

As shown in FIG. 9, the R interpolation circuit 42 has a correction operation circuit 62, an interpolation coefficient calculation unit 64 and a matrix operation circuit 66, for example.

The correction operation circuit 62 calculates horizontal positions x1, x2, x3 and x4 of a reference pixel data shown in FIG. 7 on the basis of a horizontal position x of the R pixel data to be interpolated and the correction "−c" by using the following formula (1), then outputs the calculated data to the interpolation coefficient calculation unit 64.

In this example, each of the horizontal positions x1, x2, x3 and x4 indicates a horizontal position of the center of the pixel in the respective unit areas UA1, UA2, UA3 and UA4 shown in FIG. 7.

In the present embodiment, the R pixel data of the horizontal position x in the unit area UA3 is generated by performing the interpolation processing on the basis of the R pixel data of the horizontal positions x1, x2, x3 and x4 in the unit areas UA1, UA2, UA3 and UA4 which are placed in the horizontal direction with respect to the unit area UA3 shown in FIG. 7.

$$x_1 = 1 + (x - [x]) \quad (1)$$

$$x_2 = (x - [x])$$

$$x_3 = 1 - (x - [x])$$

$$x_4 = 2 - (x - [x])$$

The interpolation coefficient calculation unit 64 operates the following formula (2) with respect to each of the horizontal positions x1, x2, x3 and x4 on the basis of data which is input from the correction operation circuit 62 to generate f(x1), f(x2), f(x3) and f(x4), then outputs the generated data to the matrix operation circuit 66. Note that, in the following formula (2), a "x-c" is used as the "x".

$$f(t) = \frac{\sin(\pi t)}{\pi t} \cong \begin{cases} 1 - 2|t|^2 + |t|^3 & \ldots (0 \le |t| < 1) \\ 4 - 8|t| + 5|t|^2 - |t|^3 & \ldots (1 \le |t| < 2) \\ 0 & \ldots (2 \le |t|) \end{cases} \quad (2)$$

The matrix operation circuit 66 performs a matrix operation shown in the following formula (3) on the basis of: f(x1), f(x2), f(x3) and f(x4) indicated by data which is input from the interpolation coefficient calculation unit 64; and the pixel data r1, r2, r3 and r4 of the R signal S_R in the horizontal positions x1, x2, x3 and x4, which data is read out from the memory 32 to calculate a pixel data r to be interpolated of the horizontal position x. The pixel data is output to the drive circuit shown in FIG. 1 as the pixel data of the R signal S_R1.

$$r = (r_1\ r_2\ r_3\ r_4)\begin{pmatrix} f(x_1) \\ f(x_2) \\ f(x_3) \\ f(x_4) \end{pmatrix} \quad (3)$$

Figure 10:
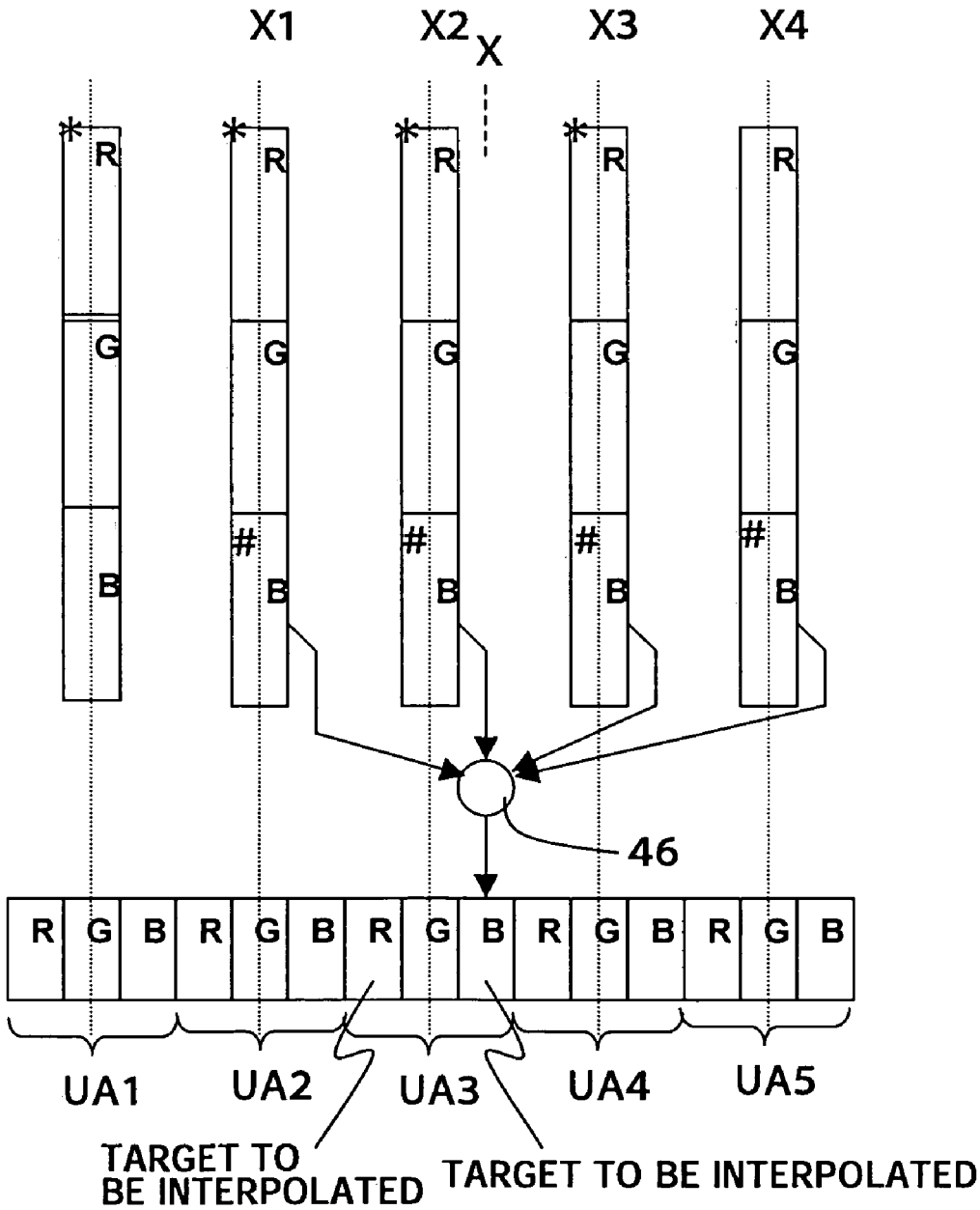
FIG. 10 is a view for illustrating an interpolation method by an R interpolation circuit shown in FIG. 6.

FIG. 10 is a view for illustrating an interpolation method by the B interpolation circuit 46.

An example shown in FIG. 10 shows a case generating the B pixel data in the unit area UA3 of the B signal S_B1.

Figure 11:
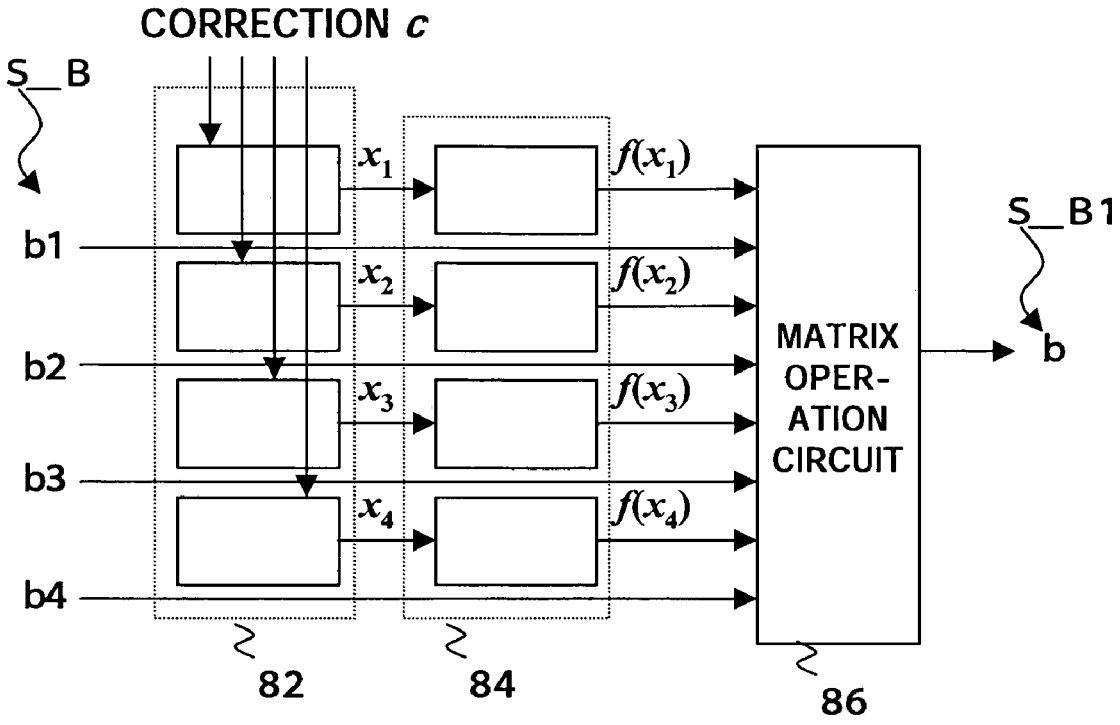
FIG. 11 is a view of a configuration of the B interpolation circuit shown in FIG. 6.

FIG. 11 is a view of a configuration of the B interpolation circuit 46 shown in FIGS. 6 and 10.

As shown in FIG. 11, the B interpolation circuit 46 has a correction operation circuit 82, an interpolation coefficient calculation unit 84 and a matrix operation circuit 86, for example.

The correction operation circuit 82 calculates horizontal positions x1, x2, x3 and x4 of a reference pixel data shown in FIG. 10 by using the above formula (1) on the basis of a horizontal position x to be interpolated of the B pixel data shown in FIG. 10 and the correction "c", then outputs the calculated data to the interpolation coefficient calculation unit 84.

In this example, each of the horizontal positions x1, x2, x3 and x4 indicates a horizontal position of the B pixel data in each of the unit areas UA2, UA3, UA4 and UA5 shown in FIG. 10.

In the present embodiment, the B pixel data of the horizontal position x in the unit area UA3 is generated by performing the interpolation processing on the basis of the B pixel data of the horizontal position x1, x2, x3 and x4 in the unit areas UA2, UA3, UA4 and UA5 which are placed in the horizontal direction with respect to the unit area UA3 shown in FIG. 10.

The interpolation coefficient calculation unit 84 operates the above formula (2) with respect to each of the horizontal positions x1, x2, x3 and x4 on the basis of data which is input from the correction operation circuit 82 to generates f(x1), f(x2), f(x3) and f(x4), then outputs the generated data to the matrix operation circuit 86. Note that, in the above formula (2), an "x+c" is used as the "x".

The matrix operation circuit 86 performs a matrix operation shown in the following formula (4) on the basis of f(x1), f(x2), f(x3) and f(x4) indicated by data which is input from the interpolation coefficient calculation unit 84 and the pixel data b1, b2, b3 and b4 of the B signal S_B in the horizontal positions x1, x2, x3 and x4 which data is read out from the memory 32 to calculate a pixel data b to be interpolated of the horizontal position x.

The pixel data b is output as a pixel data of the B signal S_B1 to the drive circuit 16.

$$b = (b_1\ b_2\ b_3\ b_4)\begin{pmatrix} f(x_1) \\ f(x_2) \\ f(x_3) \\ f(x_4) \end{pmatrix} \quad (4)$$

(Drive Circuit 16)

The drive circuit 16 makes each of the R, G, and B pixel regions in the display 10 emit light on the basis of the R signal S_R1, the G signal S_G1 and the B signal S_B1 shown in FIGS. 3C, 3B and 3D which are input from the interpolation circuit 14.

Due to this, light emitting of the pixels of R, B and B in the unit area of the display 10 is visible as a color mixed them, so that a designated color can be displayed in the unit area.

Next, an example of an operation of the color image display device 1 shown in FIG. 1 will be described.

First, the video signal processing circuit 12 generates the R signal S_R, the G signal S_G and the B signal S_B having the phases shown in FIGS. 2D, 2E, 2F on the basis of the input video signal VIDEO having the phase shown in FIG. 2B, then outputs them to the interpolation circuit 14.

Then, the interpolation circuit 14 generates the R signal S_R1, the G signal S_G1 and the B signal S_B1 shown in FIGS. 3C, 3B and 3D in accordance with the actual arrangement position of the R, G and B pixels on the basis of the R signal S_R, the G signal S_G and the B signal S_B.

Concretely, the interpolation circuit 14 generates the R signal S_R1 and the B signal S_B1 which use the center O_R of the R pixel region and the center O_B of the B pixel region as a reference respectively by the interpolation processing by using the R signal S_R and the B signal S_B generated by using the center O_UA of the unit area UA shown in FIG. 4 as a reference.

Further, the interpolation circuit 14 delays the G signal S_G which uses the center O_UA of the unit area UA as a reference by the above interpolation processing, and outputs them as the G signal S_G1.

Then, the drive circuit 16 makes the R pixel region, the G pixel region and the B pixel region in the display 10 emit light on the basis of the R signal S_R1, the G signal S_G1 and the B signal S_B1 shown in FIGS. 3C, 3B and 3D which are input from the interpolation circuit 14.

As mentioned above, the color image display device 1 generates the R signal S_R1 which uses the center O_R of the R pixel region as a reference as shown in FIG. 2E and the B signal S_B1 which uses the center O_B of the B pixel region as a reference as shown in FIG. 3D on the basis of the R signal S_R and the B signal S_B which use the center O_UA in the unit area UA shown in FIG. 4 as a reference.

Therefore, the positions which are indicated by the pixel data in the R signal S_R1 and the B signal S_B1 can be matched with the actual positions of the R pixel region and the B pixel region in the display 10, a color shift corresponding to the interval of the pixel regions which occurred in related art can be suppressed, and the display 10 can display an image in high quality.

Figure 12:
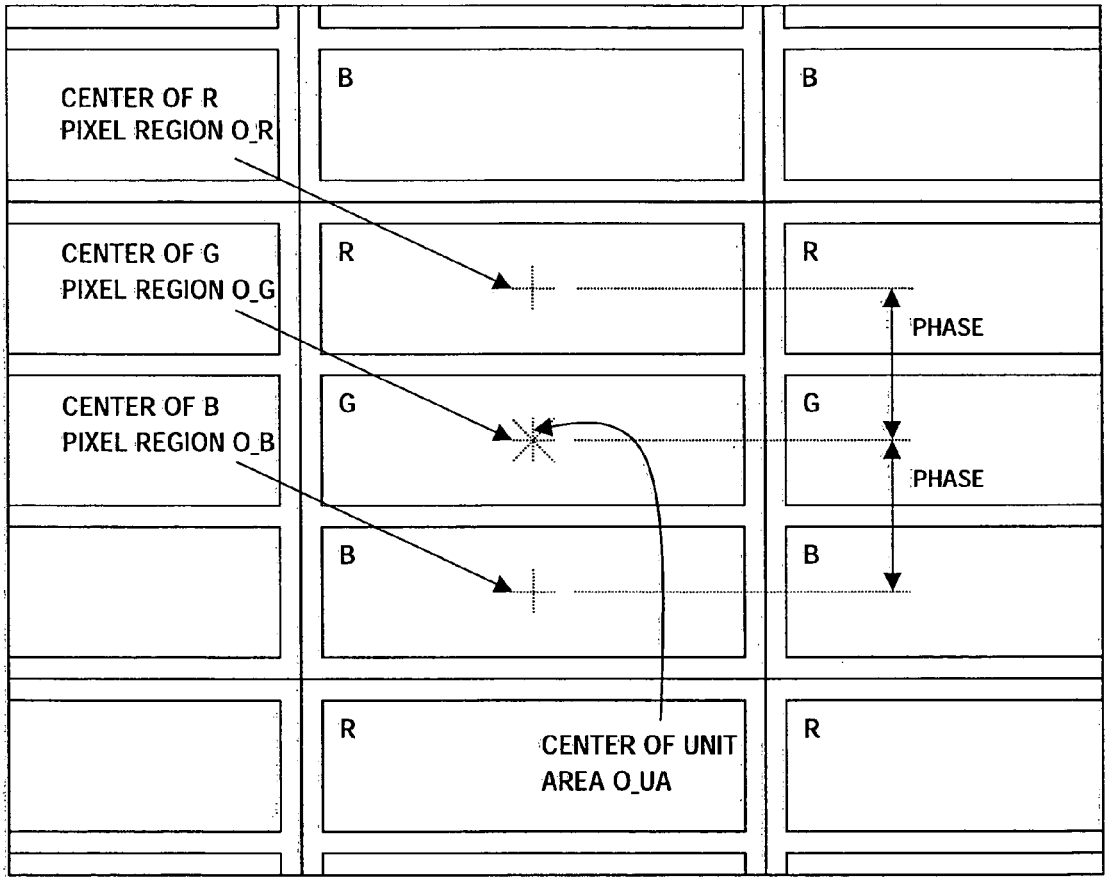
FIG. 12 is a view for illustrating a modification of the first embodiment of the present invention.

Note that, the embodiment mentioned above is illustrated with the case that the R, G and B pixel regions are successively arranged in horizontal direction in the unit area UA. Furthermore, the present invention can be similarly applied with a case that the R, G and B pixel regions are successively arranged in the vertical direction in the unit area UA as shown in FIG. 12, for example.

In this case, the vertical positions y1, y2, y3 and y4 (corresponding to the horizontal positions x1, x2, x3 and x4 in the first embodiment) of the reference pixel data are calculated by using a vertical position y instead of the horizontal position x of the R and B pixel data to be interpolated.

Second Embodiment

Figure 13:
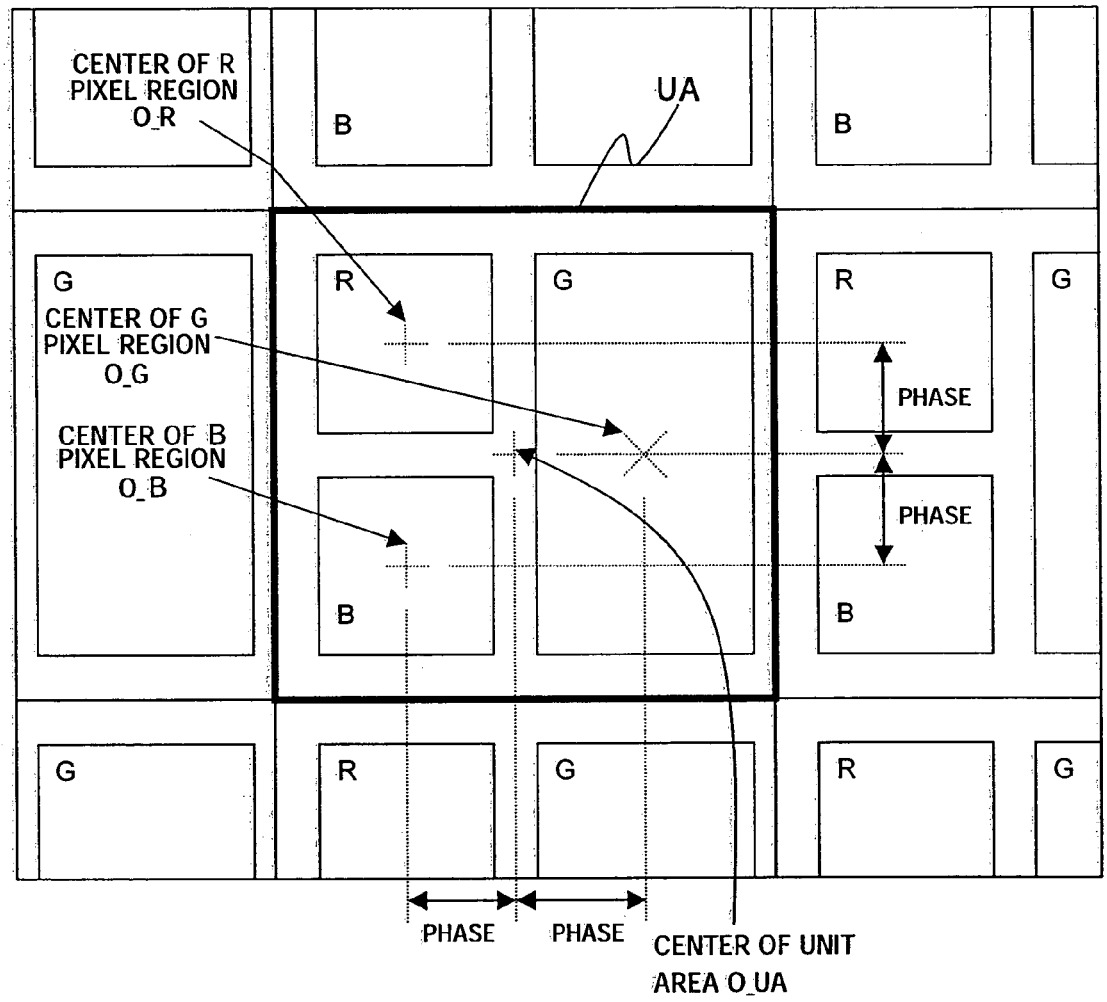
FIG. 13 is a view for illustrating a second embodiment of the present invention.

The present embodiment is same as the first embodiment with the color image display device 1 except a part of the configuration of the interpolation circuit 14 shown in FIG. 1 when the R pixel region, the G pixel region and the B pixel region are adjoining in the unit area UA in the display 10 as shown in FIG. 13, for example.

Next, the interpolation circuit 14*a* of the present embodiment will be described.

In an example shown in FIG. 13, the entire centers O_R, O_G and O_B of the R, G and B pixel regions do not match the center O_UA of the unit area UA.

The interpolation circuit 14*a* performs the interpolation processing on the basis of each of the R, G and B pixel data in 16 unit areas UA which are the sum of 4×4 (horizontal×vertical) including the unit area UA to generate each of the R, G and B pixel data in the unit area UA.

Here, an interpolation of the R pixel data will be described.

Note that, the interpolations of the G pixel data and the B pixel data are performed similarly to the R pixel data other than using another G pixel data and B pixel data respectively.

The interpolation circuit 14*a* calculates the horizontal positions x1, x2, x3 and x4 of the reference pixel data by using the following formula (5) on the basis of the horizontal position x of the R pixel data to be interpolated.

$$\begin{aligned} x_1 &= 1 + (x - [x]) \\ x_2 &= (x - [x]) \\ x_3 &= 1 - (x - [x]) \\ x_4 &= 2 - (x - [x]) \end{aligned} \tag{5}$$

Further, the interpolation circuit 14*a* calculates the vertical positions y1, y2, y3 and y4 of the reference pixel data by using the following formula (6) on the basis of the vertical position y of the R pixel data to be interpolated.

$$\begin{aligned} y_1 &= 1 + (y - [y]) \\ y_2 &= (y - [y]) \\ y_3 &= 1 - (y - [y]) \\ y_4 &= 2 - (y - [y]) \end{aligned} \tag{6}$$

Then, the interpolation circuit 14*a* operates the following formula (7) with respect to each of the horizontal positions x1, x2, x3 and x4 and the vertical positions y1, y2, y3 and y4 to generate f(x1), f(x2), f(x3), f(x4), f(y1), f(y2), f(y3) and f(y4).

$$f(t) = \frac{\sin(\pi t)}{\pi t} \cong \begin{cases} 1 - 2|t|^2 + |t|^3 & \ldots (0 \le |t| < 1) \\ 4 - 8|t| + 5|t|^2 - |t|^3 & \ldots (1 \le |t| < 2) \\ 0 & \ldots (2 \le |t|) \end{cases} \tag{7}$$

Then, the interpolation circuit 14*a* performs a matrix operation shown in the following formula (8) on the basis of the generated f(x1), f(x2), f(x3), f(x4), f(y1), f(y2), f(y3) and f(y4) and R pixels data r11, r12, r13, r14, r41, r42, r43, r44, r21, r22, r23, r24, r31, r32, r33 and r34 in 16 unit areas UA which are the sum of 4×4 (horizontal×vertical) and read out from the memory to calculate pixel data r to be interpolated of the horizontal position x and the vertical position y.

The pixel data r is output as a pixel data of the R signal S_R1 to the drive circuit 16 shown in FIG. 1.

$$r = (f(y_1)\ f(y_2)\ f(y_3)\ f(y_4)) \begin{pmatrix} r_{11} & r_{21} & r_{31} & r_{41} \\ r_{12} & r_{22} & r_{32} & r_{42} \\ r_{13} & r_{23} & r_{33} & r_{43} \\ r_{14} & r_{24} & r_{34} & r_{44} \end{pmatrix} \begin{pmatrix} f(x_1) \\ f(x_2) \\ f(x_3) \\ f(x_4) \end{pmatrix} \tag{8}$$

As mentioned above, according to the present embodiment, a color shift corresponding to the interval of the pixel regions can be suppressed even if the interpolation may be needed in the both horizontal direction and vertical direction in the entire R signal S_R, the G signal S_G and the B signal S_B, so that the display 10 can display an image in high quality.

The present invention may not limit to the embodiments mentioned above.

The present invention can be applied to the entire display device in which the pixel regions of R, G and B are arranged in the unit area.

Further, the interpolation methods by the interpolation circuits 14 and 14*a* are not limited and various interpolation methods such as a linear interpolation, a high-order interpolation, that is, no less than two-order interpolation, a bicubic interpolation or a spline interpolation can be used.

Furthermore, the interpolation circuits 14 and 14*a* may perform an interpolation on the basis of pixel data of the pixel in the unit areas other than around of the unit area which is belong to a pixel to be interpolated.

The present invention is applied to an image processing device used to a color image display using fixed pixels.

It should be understood by those skilled in the art that various modifications, combinations, sub-combinations and alterations may occur depending on design requirements and other factors in so far as they are within scope of the appeared claims or the equivalents thereof.

What is claimed is:

1. An image processing device driving a display device which makes pixels of red (R), green (G) and blue (B) arranged inside each of a plurality of areas on a screen emit light to display a designated color in the unit areas, said image processing device comprising:

a signal generation circuit determining a pixel of which an arrangement position is not matched with a reference position of the unit area used for reference by a first pixel signal of the pixel as a target to be interpolated among pixels of R, G and B, and generating a second pixel signal which uses the arrangement position of the pixel to be interpolated as a reference on the basis of the first pixel signal, wherein the reference position is a center of the unit area and the arrangement position is a center of a region in which the pixel is arranged.

2. An image processing device as set forth in claim 1, wherein said signal generation circuit performs an interpolation processing on the basis of the first pixel signal of the pixel to be interpolated and the first pixel signal of a pixel having same color in another unit area free from the pixel to be interpolated to generate the second pixel signal.

3. An image processing device as set forth in claim 1, further comprising a drive circuit driving light emission of the pixels corresponding to the second pixel signal on the basis of the pixel signal generated by the signal generation circuit.

4. An image processing device as set forth in claim 1, wherein the display device is driven, that display device makes the pixels of R, G and B which are arranged continuously or with adjoining respectively inside each of a plurality of the unit areas on the screen emit light to display the designated color in the unit area.

5. An image processing method driving a display device which makes pixels of red (R), green (G) and blue (B) arranged inside each of a plurality of areas on a screen emit light to display a designated color in areas, said image processing method comprising:

a step of determining a pixel of which an arrangement position is not matched with a reference position of the unit area used for reference by a first pixel signal of the pixel as a target to be interpolated among pixels of R, G and B, and generating a second pixel signal which uses the arrangement position of the pixel to be interpolated as a reference on the basis of the first pixel signal, and a step of driving a light emission of the pixel corresponding to the second pixel signal on the basis of the second pixel signal generated in the determining steps, wherein the reference position is a center of the unit area and the arrangement position is a center of a region in which the pixel is arranged.

6. An image processing device driving a display device which makes pixels of red (R), green (G) and blue (B) arranged inside each of a plurality of areas on a screen emit light to display a designated color in the unit areas, said image processing device comprising:

a signal generation circuit determining a pixel of which an arrangement position is not matched with a reference position of the unit area used for reference by a first pixel signal of the pixel as a target to be interpolated among pixels of R, G and B, and generating a second pixel signal which uses the arrangement position of the pixel to be interpolated as a reference on the basis of the first pixel signal, wherein the display device is driven, that display device makes the pixels of R, G and B which are arranged continuously or with adjoining respectively inside each of a plurality of the unit areas on the screen emit light to display the designated color in the unit area.

* * * * *